US006107612A

United States Patent [19]

Farant

[11] Patent Number: 6,107,612

[45] Date of Patent: Aug. 22, 2000

[54] HEATING DEVICE AND METHOD

[75] Inventor: Jean-Pierre Farant, Verdun, Canada

[73] Assignee: Martinex R & D Inc., Montreal, Canada

[21] Appl. No.: 09/013,020

[22] Filed: Jan. 26, 1998

[51] Int. Cl.[7] ..... H05B 3/34; H01C 10/10

[52] U.S. Cl. ..... 219/529; 338/99

[58] Field of Search ..... 219/529, 211, 219/212, 545; 5/423; 338/208, 99, 114, 104, 101, 115; 607/96, 99

[56] References Cited

U.S. PATENT DOCUMENTS

| | | | |
|---|---|---|---|
| 1,663,810 | 3/1928 | Morse | 219/538 |
| 3,629,774 | 12/1971 | Crites | 338/114 |
| 4,054,540 | 10/1977 | Michalchik | 252/512 |
| 4,279,188 | 7/1981 | Scott | 84/1.14 |
| 4,503,416 | 3/1985 | Kim | 338/99 |
| 4,739,299 | 4/1988 | Eventoff | 338/99 |
| 4,845,457 | 7/1989 | Nakanishi | 338/114 |
| 4,847,586 | 7/1989 | Tanaga et al. | 338/114 |
| 4,990,755 | 2/1991 | Nishimura . | |
| 5,550,339 | 8/1996 | Haugh | 200/5 A |

FOREIGN PATENT DOCUMENTS

| | | |
|---|---|---|
| 505731 | 2/1992 | European Pat. Off. . |
| 532814 | 3/1993 | European Pat. Off. . |

OTHER PUBLICATIONS

WPI English language Abstract of EP 532,814.

*Primary Examiner*—Teresa Walberg
*Assistant Examiner*—Daniel Robinson
*Attorney, Agent, or Firm*—Swabey Ogilvy Renault

[57] ABSTRACT

A device and method for generating heat employs a heating element which is resiliently compressible or in which the electrical resistance can otherwise be varied, for a given electric current, to vary the level of heat generated. In a specific embodiment the device employs a plurality of layers of electrically conductive cloth material, for example, carbon cloth, disposed between electrodes; adjustment of the spacing between the electrodes alters the degree of compression and the electrical resistance of the plurality of layers whereby the level of heat generated for a given electric current can be varied.

8 Claims, 8 Drawing Sheets

HEATING DEVICE AND METHOD

BACKGROUND OF THE INVENTION i) Field of the Invention

This invention relates to a device which generates heat and to a method of generating heat.

ii) Description of Prior Art

Electrical heaters and other devices in which heat is developed electrically for different purposes all employ flow of electric current through an electrically conductive heating element. The heat generated by the heating element depends on the current flow and the electric resistance of the heating element.

The amount of heat produced is based on Joule's Law as set out in equation (I)

$$H_c = I^2R \quad \text{(I)}$$

where:

$H_c$=heat in watts

I=current in amps

R=resistance in ohms.

This relationship may be expressed in more practical terms by equation (2)

$$H_s = 0.24I^2Rt \quad (2)$$

In equation (2) the constant 0.24 is the heat equivalent of electricity, and $H_s$=watt seconds t=time in seconds.

In existing heat generating devices the heat produced is controlled or varied by selecting or varying the current applied to the heating element, the resistance of the heating element being maintained constant.

Prior heat generating devices thus require increased amounts of electricity to raise the level of heat generation whereby operating the device at higher heat generation consumes a greater amount of electricity and thus higher cost.

SUMMARY OF THE INVENTION

It is an object of this invention to provide a device and method for generating heat.

It is a particular object of this invention to provide a heat generating device and method, in which heat generation can be increased without increase in the current flow.

In accordance with one aspect of the invention there is provided a device which generates heat comprising: first and second spaced apart electrodes, a resiliently compressible, electrically conductive heating element electrically connected to said spaced apart electrodes for flow of electric current between said electrodes and through said heating element, said heating element generating heat on passage of electric current therethrough, and means to vary the compression of said heating element.

In accordance with another aspect of the invention there is provided a heating device comprising: first and second spaced apart electrodes, a variable separating space defined between said spaced apart electrodes, occupied by a resiliently compressible, electrically conductive heating element in electrical contact with said electrodes and which generates heat on flow of electric current between said electrodes and through said heating element, at least said first electrode being adjustably positionable relative to said second electrode to vary said separating space such that electrical resistance of said heating element may be varied, while maintaining electrical contact between said electrodes through said heating element.

In accordance with a particular embodiment of the invention there is provided a heating device which comprises: first and second spaced apart electrodes, a variable separating space defined between said spaced apart electrodes occupied by a resiliently compressible plurality of layers of electrically conductive cloth material, said layers being in adjacent, side-by-side electrically contacting relationship, said plurality of layers comprising a first outer layer in electrical contact with said first electrode, and a second outer layer in electrical contact with said second electrode, at least said first electrode being adjustably positionable relative to said second electrode to vary said separating space between said electrodes while maintaining electrical contact between the adjacent layers and between said plurality of layers and said electrodes, thereby compressing or decompressing said plurality of layers, whereby the electrical resistance of said plurality of layers is varied.

In accordance with still another aspect of the invention there is provided a heat generating device comprising first and second spaced apart electrodes, a plurality of layers of electrically conductive cloth material disposed between said electrodes, each layer of said plurality being in electrical contact with at least an adjacent layer of said plurality, said plurality comprising a first outer layer in electrical contact with said first electrode and a second outer layer in electrical contact with said second electrode, said plurality of layers being resiliently compressible between said first and second outer layers to different states of compression and having a different electric resistance associated with each different state of compression whereby a desired resistance with consequent level of heat generation is provided by a predetermined state of compression.

In accordance with yet another aspect of the invention there is provided a method of generating heat comprising feeding an electric current between first and second spaced apart electrodes and through an electrically conductive heating element disposed electrically between said electrodes, and varying the electric resistance of said heating element to vary the generation of heat by said heating element.

In still another aspect of the invention there is provided a method of generating heating comprising feeding an electric current between first and second spaced apart electrodes and through a resiliently, compressible, electrically conductive heating element disposed electrically between said electrodes and altering the level of compression of said heating element to vary the generation of heat by said heating element.

DESCRIPTION OF PREFERRED EMBODIMENTS i) Heating Element a) Electrical Resistance The heating element in the device of the invention is electrically conductive but has sufficient electrical resistance to generate heat during passage of electricity, to perform a desired heating effect.

In accordance with the invention the amount of heat generated is increased or decreased by increasing or decreasing the electrical resistance. Thus to increase the heat generated in unit time, the electrical resistance is increased and to reduce the heat generated in unit time the electrical resistance is decreased, at a constant electric current.

It will be understood that it is within the scope of the invention to additionally alter the heating characteristics by altering the current as in conventional heating devices, but the present invention is more especially concerned with devices in which the heating characteristics are altered by change of the electrical resistance of the heating element at a constant electric current.

In accordance with the invention, the change in electrical resistance is particularly achieved by employing a heating element which is resiliently compressible. Compressing the heating element decreases the resistance and thus decreases the heat generated at a constant electric current. Decompressing the compressed heating element increases the resistance, restoring the resistance of the initial state and thus increases the heat generated to the level associated with such initial state. Different levels of compression are associated with different electric resistance values and thus different levels of heat generation.

b) Resiliently Compressible Cloth Layers

The expression "resiliently compressible" is to be understood as indicating that the heating element can be compressed by application of a compressing force to the heating element, and that the heating element expands or is restored to substantially its pre-compression state on removal of the compressing force. In part the heating element may be considered to have an elastic memory of the pre-compression state so that it can be compressed repeatedly to different levels of compression but restored to the initial state or to a less compressed state on release or partial release of the compressive force.

It will be understood that the resilience or ability of the compressed heating element to relax to its pre-compression state may be altered by age.

References to varying the compression of the heating element contemplate decreasing the compression, i.e., decompressing so as to increase the heat generated and increasing the compression, i.e., compressing to decrease the heat generated.

The heating element may be in a partially compressed state initially to effect a desired initial level of heating for a particular electric current. The heating element may then be subjected to decreasing levels of compression to increase the level of heat generated.

The heating element should suitably be of a material which withstands the heat which it generates at temperatures to be developed by the heating element and which does not degenerate on continuous, continual or repeated exposure to such heat. In the case of heating elements which are to be employed to develop high temperatures at which the element degenerates on exposure to oxygen or air, the heating element may be maintained in an inert atmosphere to avoid such degeneration, or may be chemically treated to prevent or inhibit such degeneration, or may be coated with or otherwise protected by a heat conductive material which does not degenerate on exposure to heat and oxygen at high temperatures, for example, silicon rubber. The heating element may, in particular, comprise a plurality of layers of electrically conductive cloth material in adjacent side-by-side relationship, each layer of the plurality is in electrical contact at least with an adjacent layer and in particular a major face of each cloth layer is in electrical contact with a major face of an adjacent cloth layer, the cloth layers forming a stack bed or pile in which the layers are in opposed facing relation. The stack or pile need not, however, be disposed such that the layers are horizontal and any disposition of the layers from horizontally oriented to vertically oriented is possible.

The plurality of layers may be formed from discrete separate layers which may be the same or different, or may be formed from a continuous length of cloth folded repeatedly in concertina fashion to produce the plurality of layers or may be formed from combinations of separate lengths folded in concertina fashion and stacked together or combinations of separate lengths folded in concertina fashion and discrete separate layers, stacked together.

c) Carbon and Graphite Cloth Layers

In accordance with the invention it has surprisingly been found that cloth materials which rely on carbon or graphite for electrical conductivity not only achieve a wide range of heat generation on compression, but heat increase is achieved rapidly on application of relatively minor compressive force.

In particular, the cloth material which may, for example, be woven, non-woven, knitted or felted may be carbon cloth, graphite cloth, carbon felt, graphite felt, graphite impregnated cloth such as graphite impregnated carbon cloth, carbon impregnated cloth or graphitized carbon cloth.

The carbon and graphite cloths and felts are formed by carbonizing or graphitizing cloths and felts of organic fibers, filaments, monofilament yarns and multi-filament yams which may be synthetic, for example, polyacrylonitrile fibers, filaments or yarns, or natural, for example, cotton.

Carbon cloths deteriorate in the presence of oxygen at temperatures above 400° C. and graphite cloths deteriorate at temperatures above 700° C. In applications where these cloths are employed for development of temperatures above these levels, chemical treatment of the cloths to inhibit oxidation, may be necessary, or exclusion of oxygen by confining the heating element in an inert atmosphere.

d) Compressive Force

In especially preferred embodiments the resiliently compressible, electrically conductive cloth material layers are disposed in the separating space between a pair of spaced apart electrodes such that the outermost layers of the plurality of layers are in electrical contact with the electrodes, thereby providing a path for flow of electric current between the electrodes.

In this case, one or both of the electrodes is adjustably positionable to alter the distance separating the electrodes, i.e., the length of the separating space. Adjusting the position of one or both of the electrodes to vary the distance separating them provides the compressive or decompressive force on the plurality of cloth layers.

It is also possible, however, to dispose the layers between a pair of spaced apart insulated members, for example, ceramic members, with electrical connectors extending from the electrodes through the insulated members to make electrical contact with the cloth layers or directly to the outer cloth layers. In this case adjusting the position of one or both of the insulated members to vary the separating space between the insulated members provides the required compressive or decompressive force.

It will be understood that the electrodes or insulated members must have a structural integrity capable of applying the compressive force to the cloth layers.

In tests employing a plurality of layers of carbon cloth as the heating element disposed in the space between the electrodes and maintained under an inert atmosphere of helium, and in electrical contact with the electrodes, it was observed that temperatures ranging from ambient to in excess of 1000° C. were obtained in a short period, typically less than 60 seconds, by making modest adjustments to increase the spacing between the electrodes while maintaining the current constant.

ii) Heat Generating Devices

The heat generating device which exploits the heating element of the invention may be a heater for industrial, commercial or residential use employing AC or DC current, for example, electrical mains, power supply or a battery as the source of electricity. In such heaters the prime objective is to heat the ambient environment. In such heaters the ability to adjust the heater to raise the temperature of the environment or permit the temperature to fall is important.

The heating element may also be employed in devices where the heat is generated for some other purpose, for example, where heat is required in industrial processes. In such cases it may suffice that the device develops a particular temperature for the desired use. In such case the resistance of the heating element may be present, for example, at an appropriate compression, to achieve the desired temperature, without provision for varying the compression or resistance to alter the level of heat generated unless so desired.

DESCRIPTION OF PREFERRED EMBODIMENTS WITH REFERENCE TO DRAWINGS

Figure 1A:
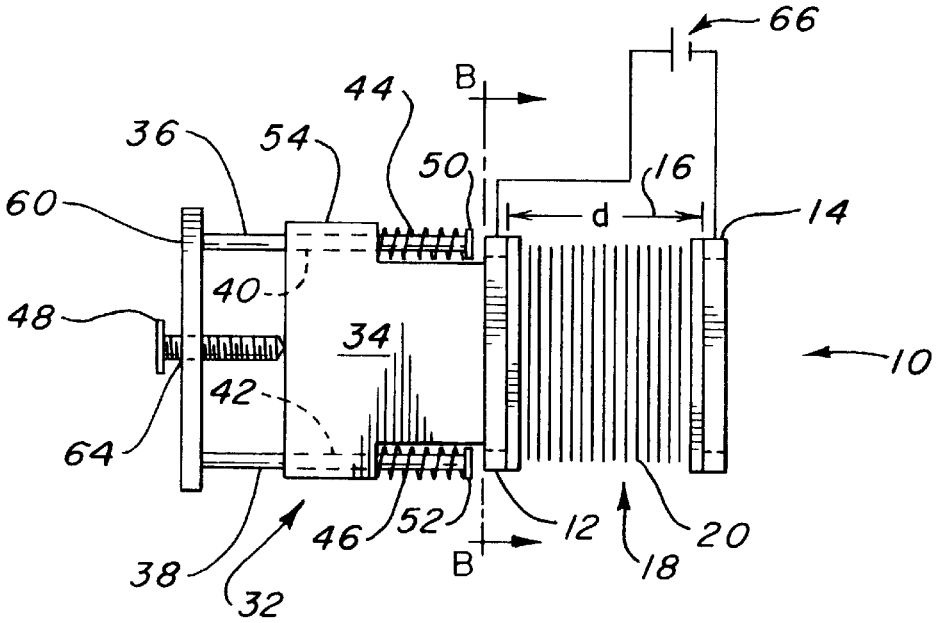
FIG. 1A is a schematic representation of a heating device of the invention.
Figure 1B:
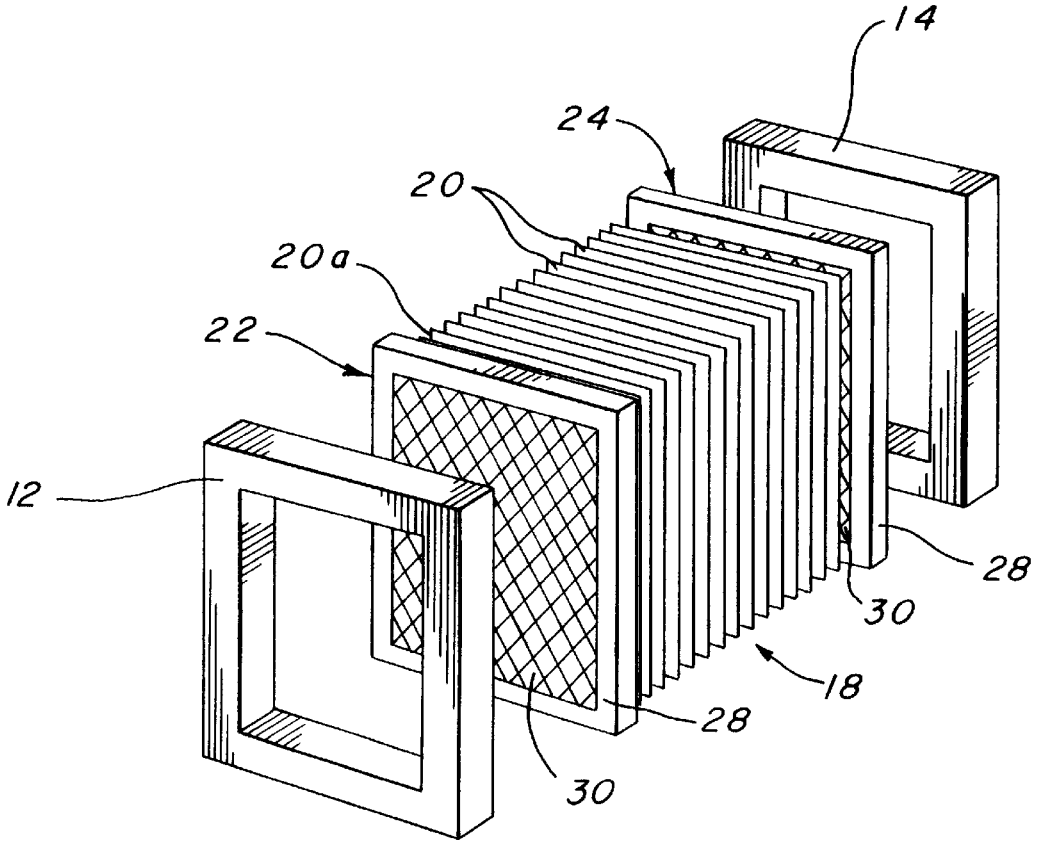
FIG. 1B is a partial exploded view of the heating device of FIG. 1A along line B—B.

With further reference to FIGS. 1A and 1B a heating device 10 includes electrodes 12 and 14 having a space 16 therebetween with a separating distance "d".

The space 16 is occupied by a heating element 18 comprising a plurality of layers 20 of electrically conductive carbon cloth including an outer layer 20*a* and an outer layer 20*b*.

The layers 20 are held in space 16 between electrically conductive screens 22 and 24 which are in electrical contact with outer layers 20*a* and 22*b* respectively and with electrodes 12 and 14 respectively. Each of the layers 20, 20*a* and 20*b* of heating element 18 is in electrical contact with an adjacent layer 20.

Screens 22 and 24 each have a frame 28 and mesh 30 both of which are electrically conductive.

A gap adjuster 32 includes a plunger 34, rods 36 and 38 extending through bores 40 and 42 in plunger 34, compression springs 44 and 46 and an adjustment screw 48.

Compression springs 44 and 46 abut stationary surfaces 50 and 52 of housing 15, and arms 54 and 56 of plunger 34.

Rods 36 and 38 extend between stationary surfaces 50 and 52 and stationary support surface 60.

Adjustment screw 48 may typically be a Vernier screw having an end 62 abutting plunger 34. Screw 48 is threadedly engaged in a stationary threaded bore 64, in support surface 60.

The screens 22 and 24 offer minimal electrical resistance and may be considered extensions of the electrodes 12 and 14.

Electrodes 12 and 14 are connected to a source of electricity 66 which may be, for example, a power outlet of an AC or DC supply or a battery.

The electrode 12 may be secured to plunger 34.

Figure 1C:
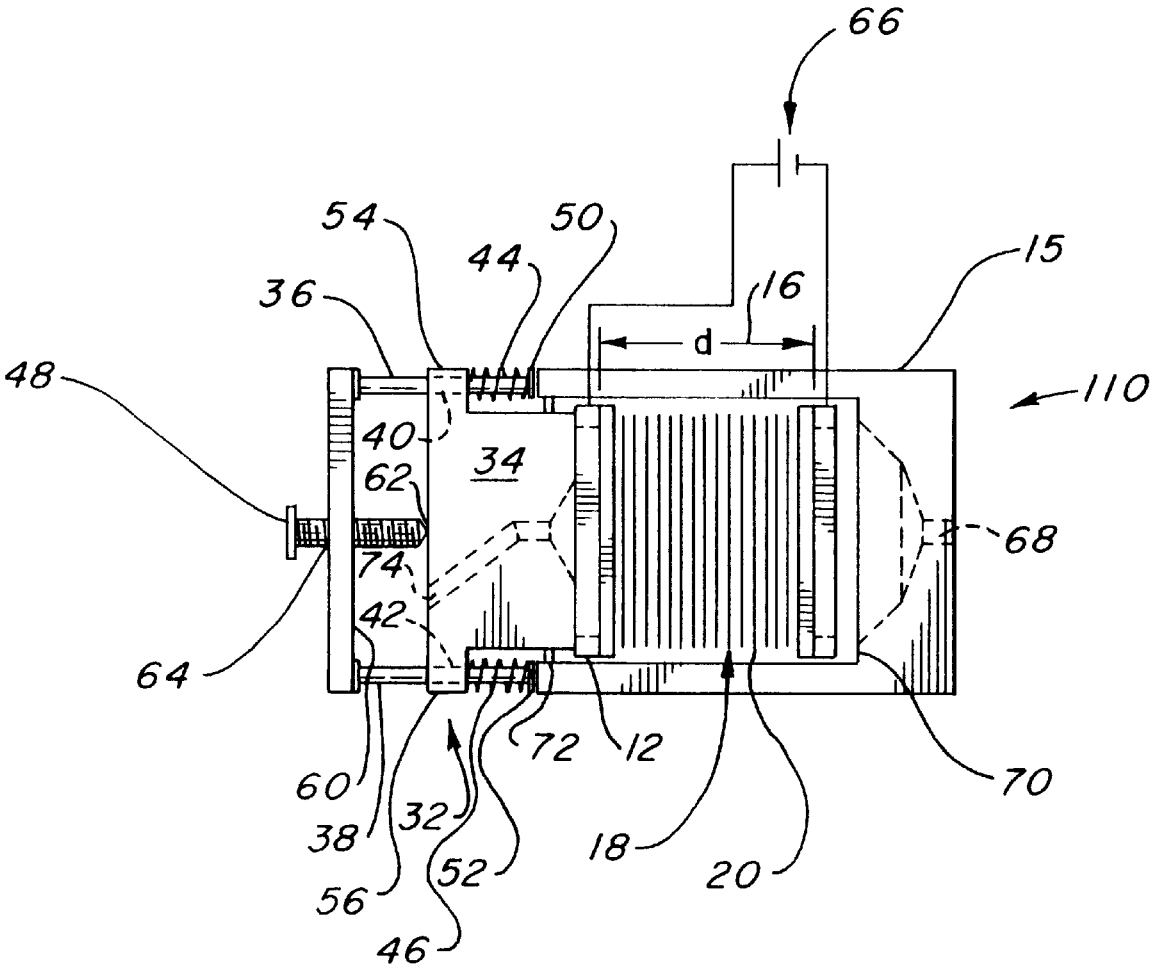
FIG. 1C is a schematic representation of the heating device in a different embodiment.

With further reference to FIG. 1C there is shown a heating device 110 which has many of the features of device 10 of FIGS. 1A and 1B. In FIG 1C the same integers are employed to identify parts which are the same or equivalent to those in FIGS. 1A and 1B.

The heating device 110 has provision to protect the heating element 18 from ambient oxygen, where high temperatures are to be developed.

In FIG. 1C heating element 18 and electrodes 12, 14 are contained within a housing 15.

Housing 15 includes an inlet 68 for an inert gas, for example, helium or nitrogen and a porous plate 70.

Sealing ring 72 is disposed between housing 15 and plunger 34 and plunger 34 has an outlet 74 for the inert gas.

In operation electric current is fed from source 66 between electrodes 12 and 14 and flows through the heating element 18 where heat is generated. As shown in FIGS. 1A and 1C the electrodes 12 and 14 are spaced apart by distance "d".

In order to decrease the heat generated screw 48 is rotated to advance it through threaded bore 64 whereby end 62 which abuts plunger 34 urges plunger 34 against the action of compression springs 44 and 46 which are compressed whereby electrode 12 is displaced towards electrode 14 which is held stationary, thereby shortening distance "d", the layers 20 being compressed together in the reduced space 16.

When it is desired to increase the heat the procedure is reversed. Screw 48 is retracted in threaded bore 64 and with the release of pressure on plunger 34, compression springs 44 and 46 expand urging plunger 34 in the direction of retraction of screw 48. The release of pressure by plunger 34 also allows the compressed layers 20 to resiliently decompress or expand urging electrode 12 away from electrode 14 with lengthening of distance "d" of space 16.

In the case where electrode 12 is secured to plunger 34, electrode 12 is, of course, retracted by plunger 34, and the compressed layers 20 decompress to occupy the enlarged space 16.

During this procedure the electric current is maintained constant. When the carbon cloth layers are compressed the electrical resistance decreases whereby the heat generated decreases. When the compressed carbon cloth layers are decompressed the electrical resistance increases whereby the heat generated increases.

In the device 110 an inert gas flows through inlet 68 and plate 70 about the heating element to prevent thermal degradation of the layer 20. The gas exits through outlet 74 and may be recirculated to inlet 68.

While in the devices 10 and 110 described above, reliance is made on the ability of the compressed layers 20 to expand, on removal of the compressive force provided by screw 48, and for such expansion to urge electrode 12 away from electrode 14; it is within the scope of the invention to employ a control mechanism for adjusting the separation of the electrode 12 and 14 both during compression and decomposition.

EXAMPLE

The invention is illustrated with results of electrothermal tests conducted with a carbon cloth obtained from Seibe Gorman (Wales, U.K.), namely, Protosorb (Trade-mark) 6/10 mesh and a graphite cloth obtained from Alfa (Aesar).

Figure 2:
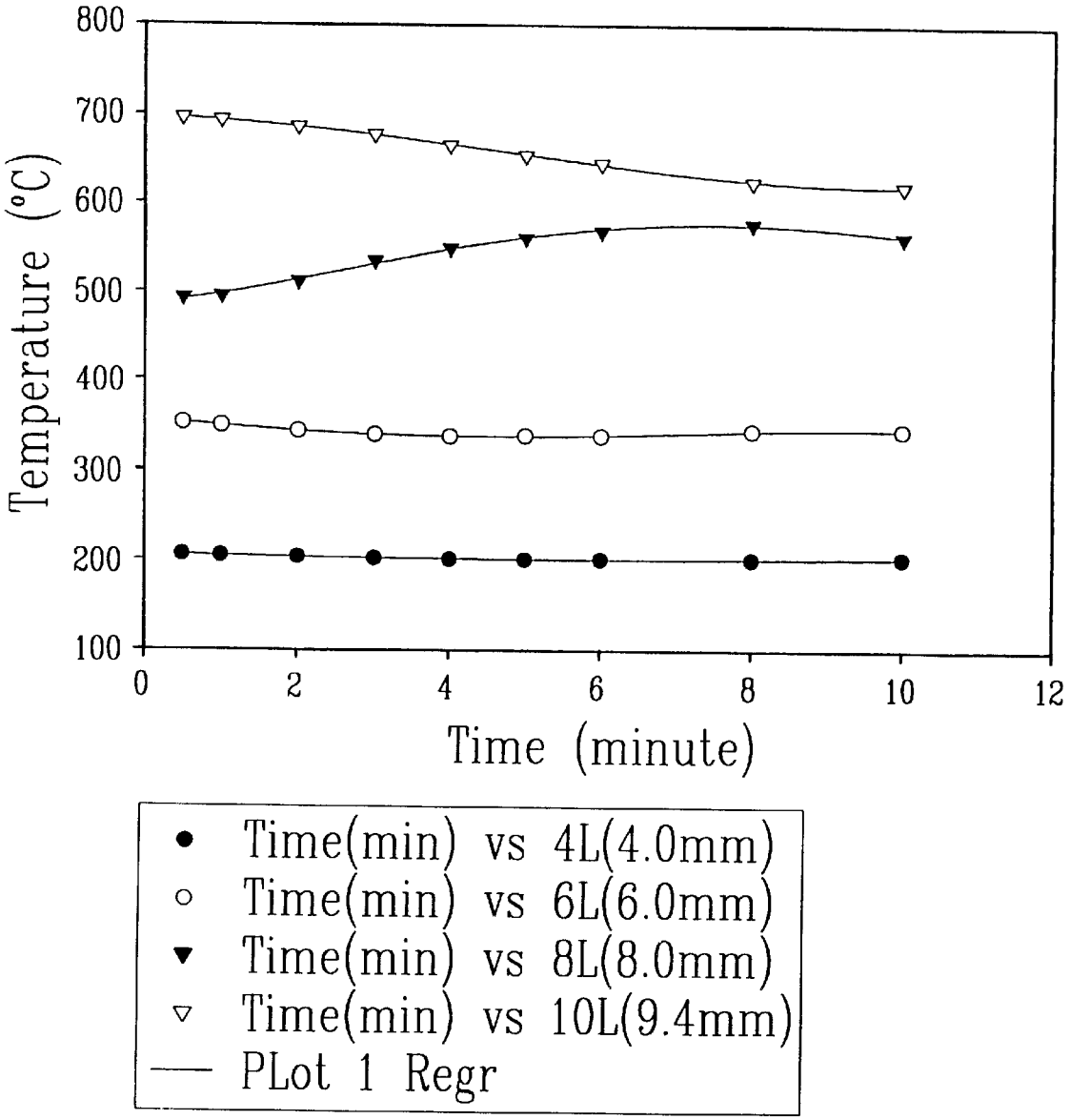
FIG. 2 illustrates graphically the increase in temperature achieved by increasing the number of carbon cloth layers and thus also the electrode spacing, in a heating device of the invention.

The effects of varying the number of layers are self evident in FIG. 2. The same DC current 5 amperes and nominally equivalent degree of compression were maintained for the 10-minute test period. The rapidity which with which the carbon cloth attains a high temperature in all cases and maintains it is noteworthy. Tests show that the temperature throughout the carbon cloth bed is relatively uniform.

Figure 3:
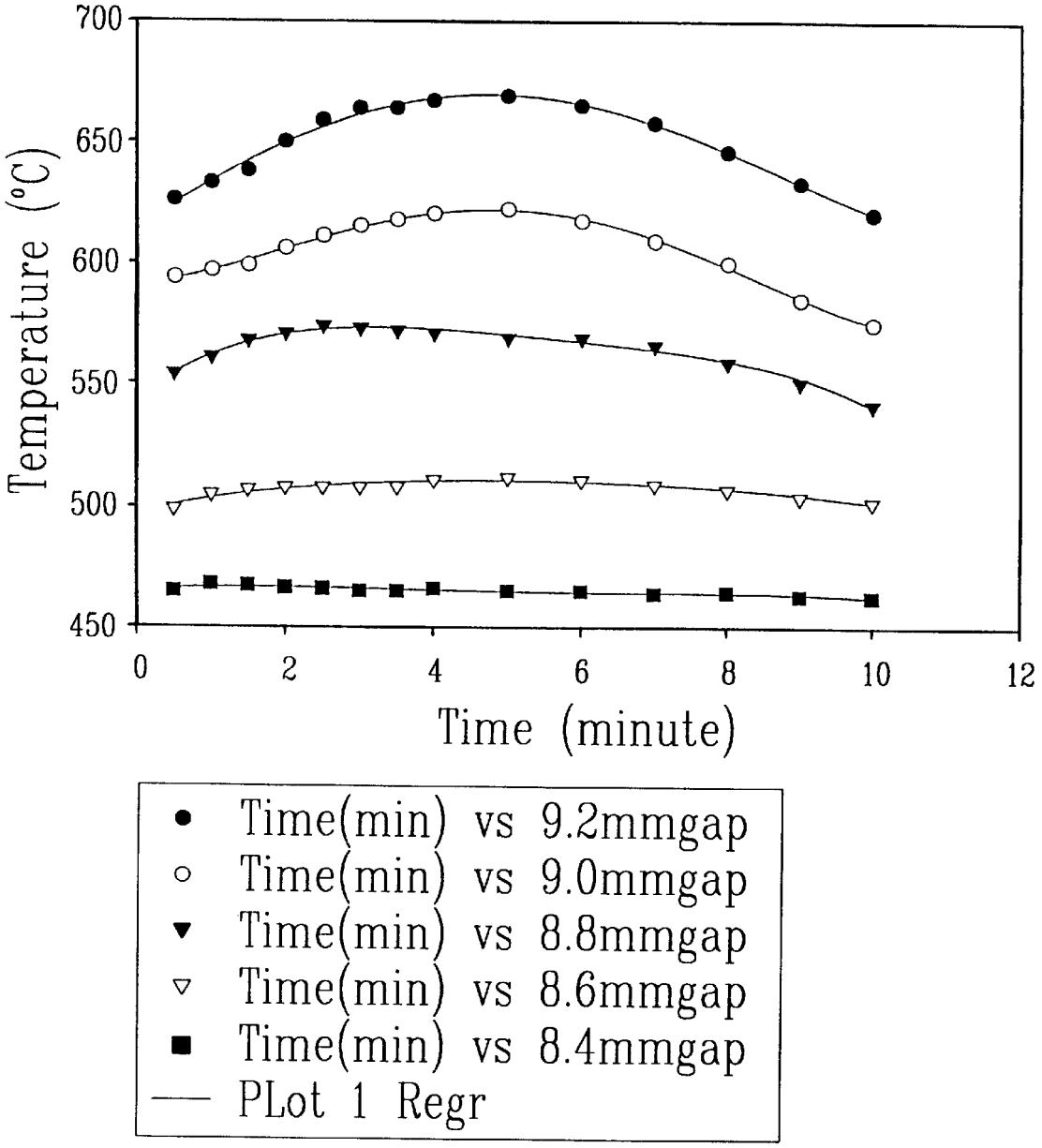
FIG. 3 illustrates graphically the variation in temperature achieved by varying the spacing or gap between the electrodes.
Figure 4:
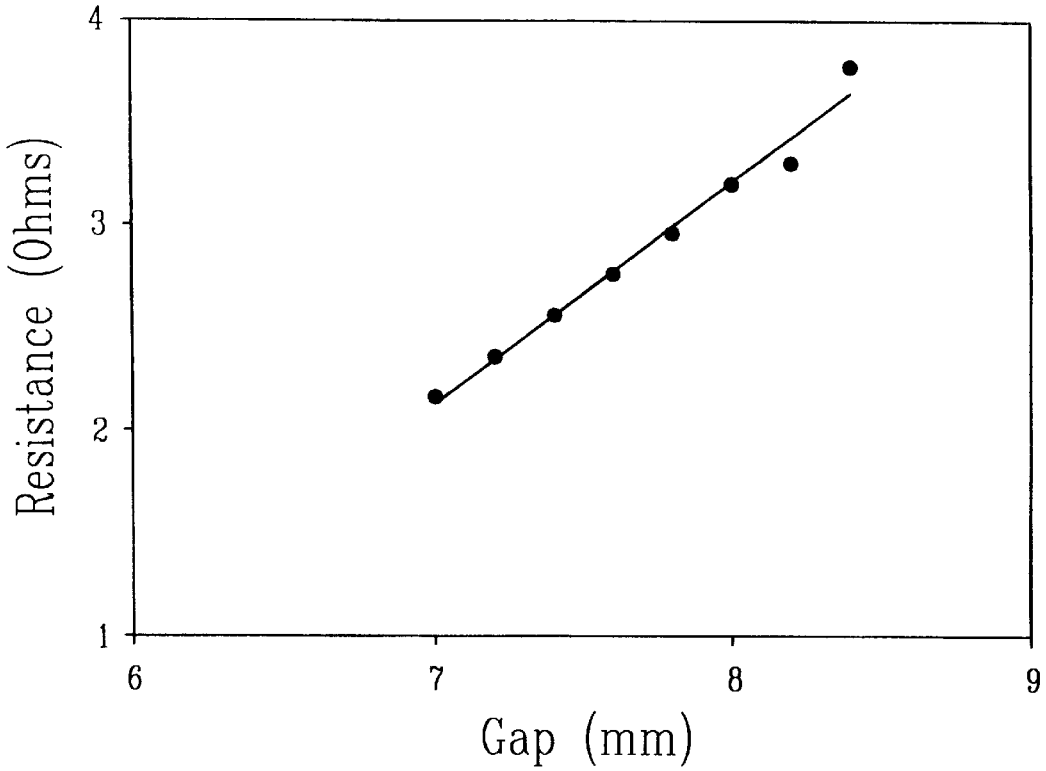
FIG. 4 illustrates graphically the variation in resistance of a constant plurality of carbon cloth layers, with variation in the electrode spacing or gap.

The effect of varying the spacing or gap between the cathode and the anode by 0.2 mm on the temperature obtained with 10 layers of the same cloth is shown in FIG. 3 using the same test conditions (5 amperes DC, 50 ml</min helium gas). The concomitant increase in resistance with increasing gap size is shown in FIG. 4 for the case where 8 layers of this cloth were tested (5 amps DC, $r^2$=0.98). FIG. 4 also illustrates the relatively low resistance values associated with the attainment of such elevated temperatures. A temperature of 890° C. was reached with 10 layers and a 10.2 mm gap. Temperatures exceeding 1000° C. could be reached with a larger number of layers of carbon cloth and a judiciously selected gap size.

Figure 5:
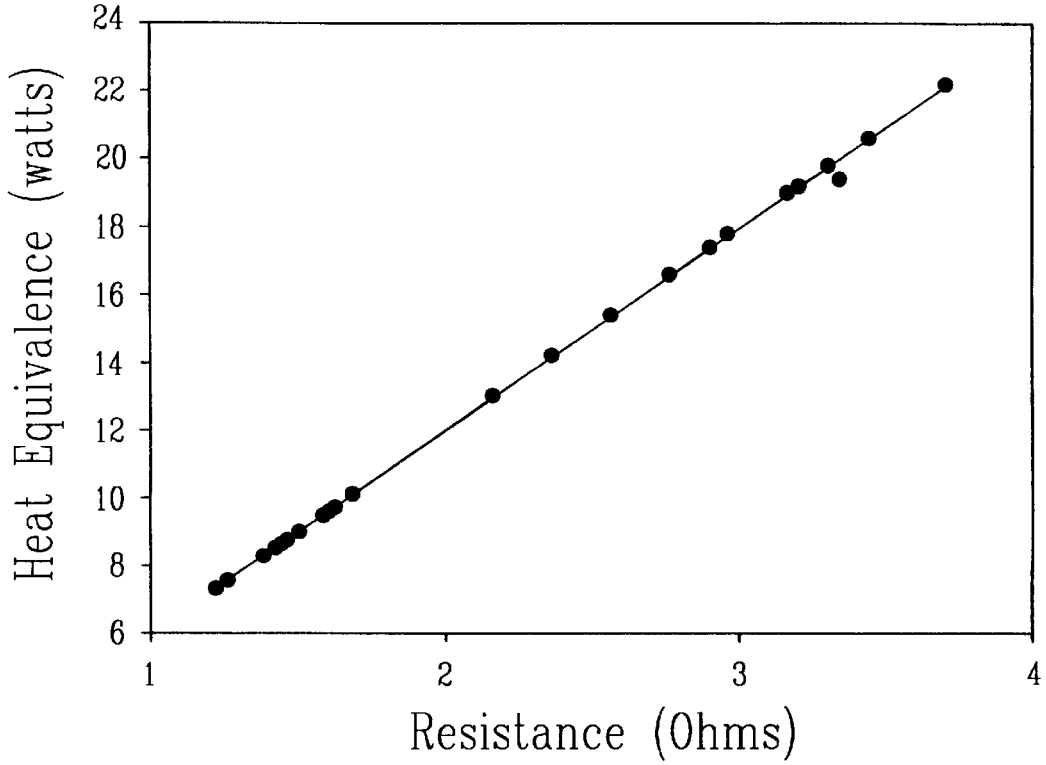
FIG. 5 illustrates graphically the variation in heat equivalence with resistance, in a heating device of the invention, with variation in the number of layers of carbon cloth and/or of the electrode spacing or gap, at a constant current.
Figure 6:
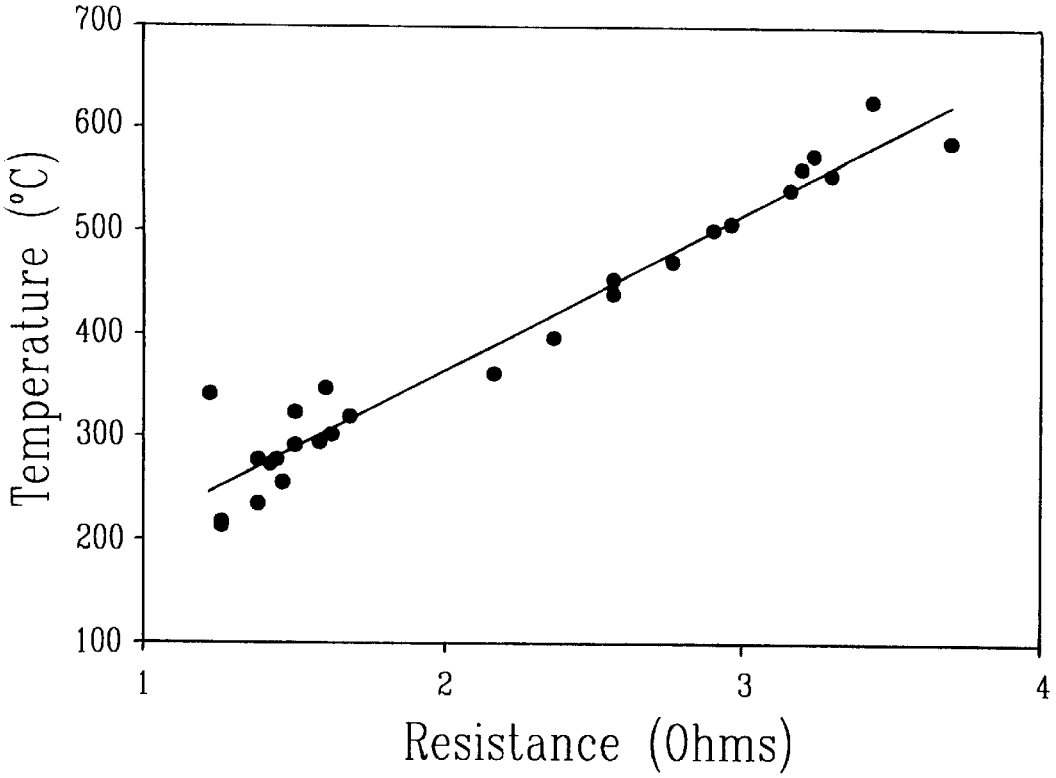
FIG. 6 illustrates graphically the variation in temperature developed with resistance, in a heating device of the invention, with variation in the number of layers of carbon cloth and/or of the electrode spacing or gap, at a constant current.

The linear relationship achieved between the resistance obtained with various numbers of layers of cloth (4, 6, 8 and 10) and associated gap sizes, and the heat produced is shown in FIG. 5 (5 amps DC, $r^2$=0.999). This relationship is reflected in FIG. 6 (5 amps DC, $r^2$=0.95) which shows the temperatures that were obtained by varying the resistance of the heating element (various numbers of cloth layers and gap sizes).

Figure 7:
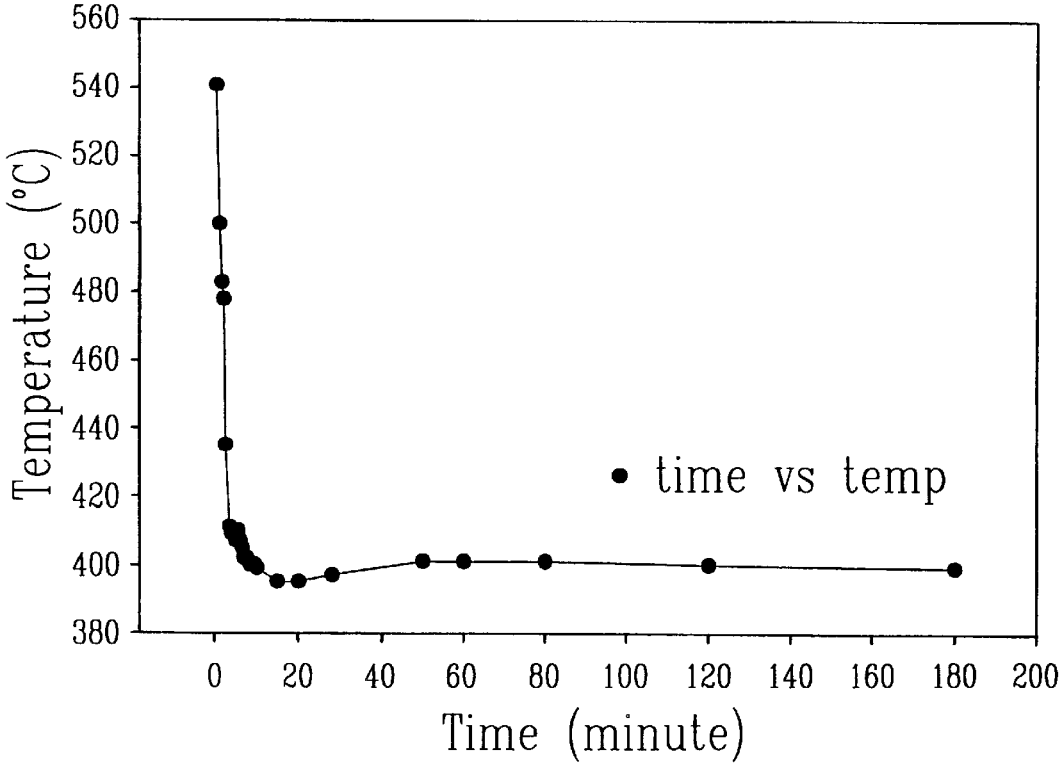
FIG. 7 illustrates graphically the long term performance of a heating device of the invention under constant conditions.

The long-term performance of 8 layers of the same cloth material (7.04 mm gap size) under the same test conditions is illustrated in FIG. 7. The initial temperature of 542° C. reached within 15 seconds and its initial decay to a relatively constant 400° C. after 10 minutes is a phenomenon observed whenever a new cloth sample is initially conditioned electrothermally. The temperature of 400° C. was reproducible during further tests.

Figure 8:
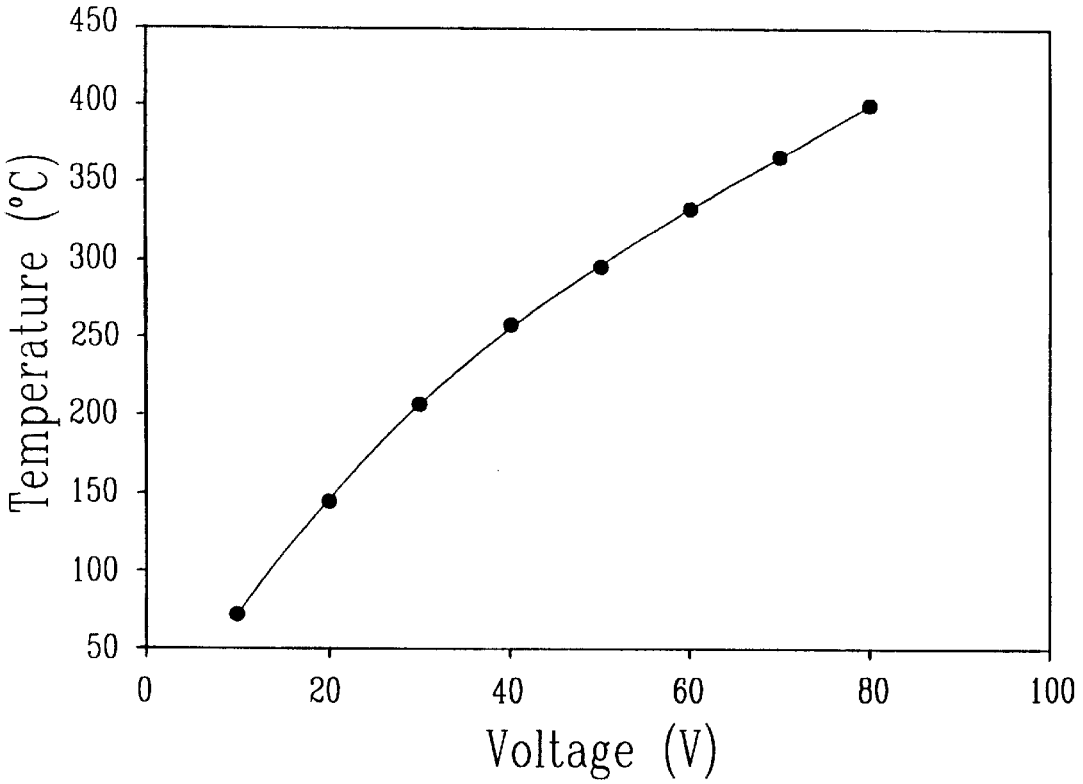
FIG. 8 illustrates graphically the variation of temperature developed employing AC current rather than DC current.

AC as well as DC current can be applied to the cloth sample yielding similar results. This is shown in FIG. 8 for eight layers of the same cloth and test conditions (7.4 mm gap size). Higher temperatures can be obtained with AC than with DC since sources of 15 amps AC are readily available.

Figure 9:
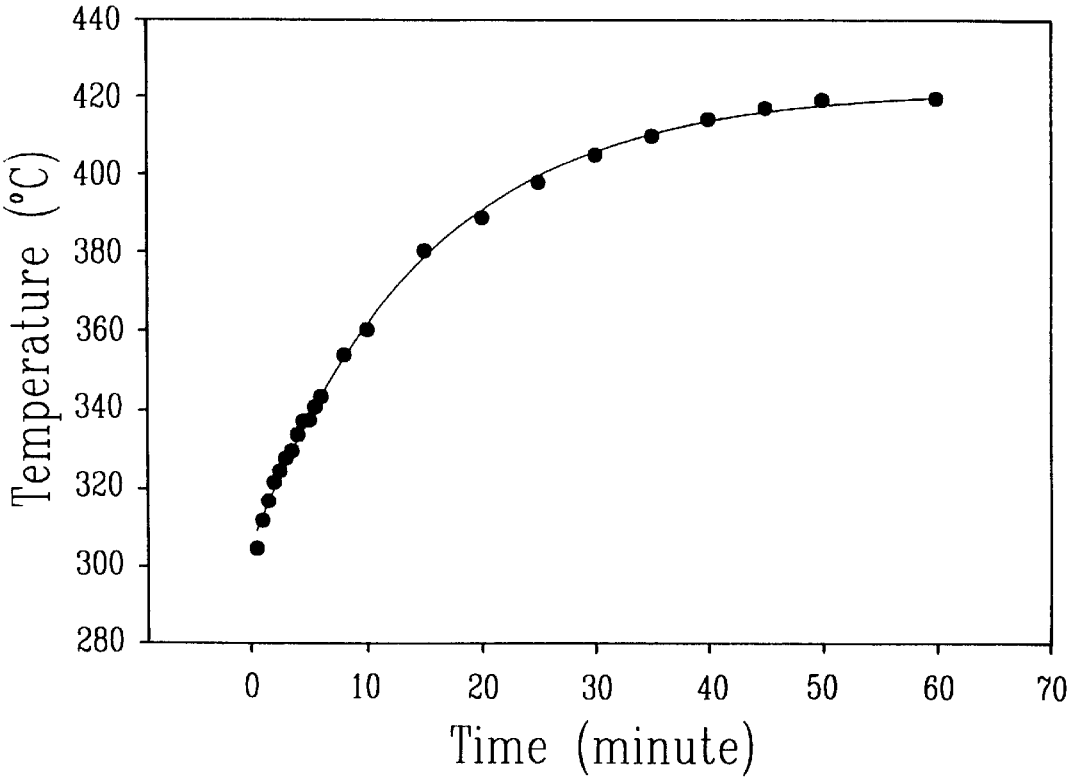
FIG. 9 illustrates graphically development of temperatures with time but employing graphite cloth layers instead of carbon cloth layers.

Similar results were obtained with tests conducted with graphite cloth (Aesar, graphite tape, 0.56 mm thickness). The results obtained with 8 layers of graphite cloth (13.0 mm gap, 5 amps DC) are shown in FIG. 9. A steady state temperature is usually reached after 30 minutes. This is somewhat less than that obtained with 8 layers of carbon cloth and a smaller gap size (8 mm) under similar test conditions. This is understandable, considering the greater conductivity of graphite.

Figure 10:
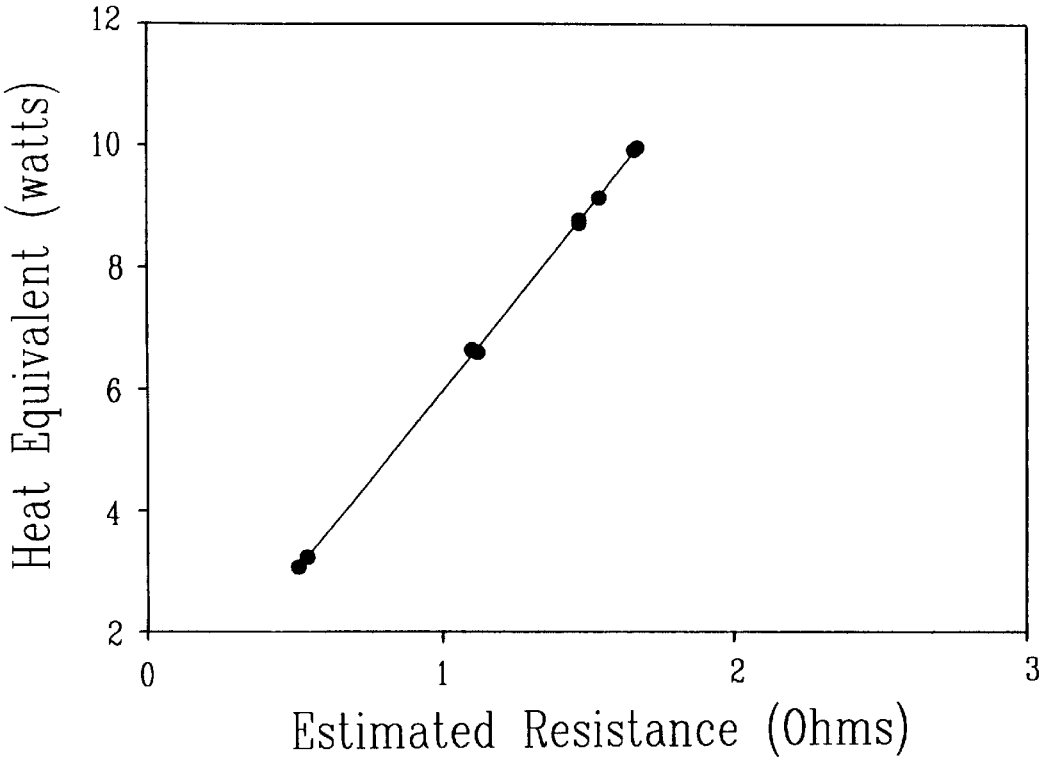
FIG. 10 is similar to FIG. 5 but employing graphite cloth instead of carbon cloth.
Figure 11:
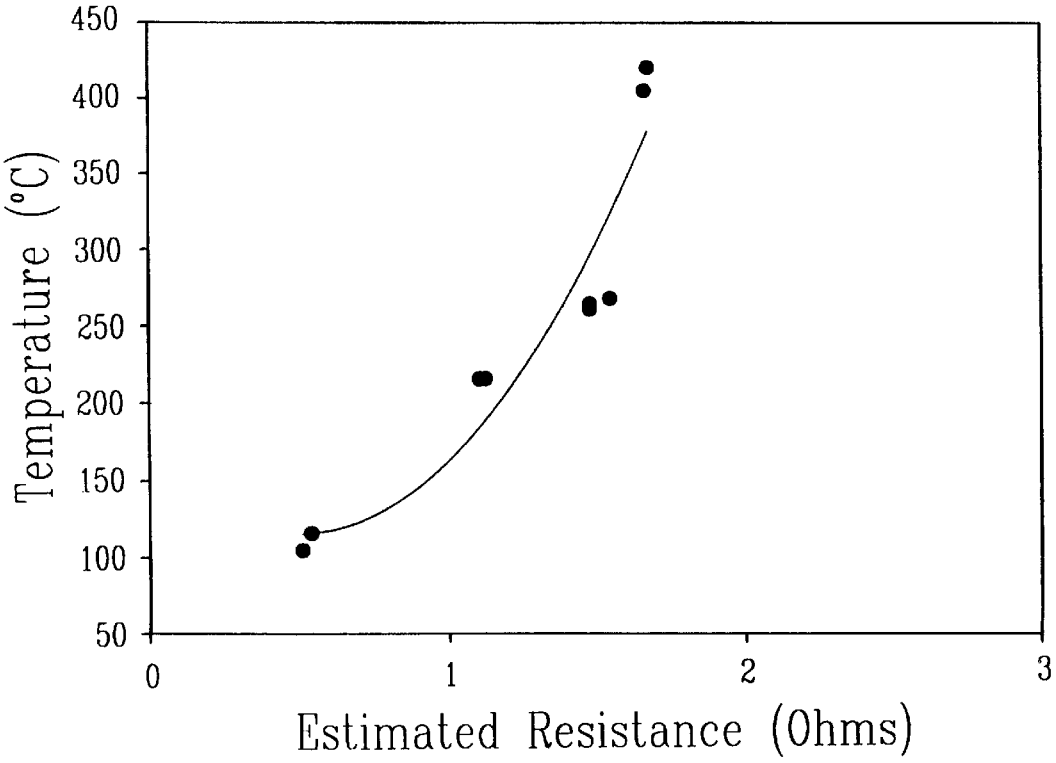
FIG. 11 is similar to FIG. 6 but employing graphite cloth instead of carbon cloth.

FIG. 10 shows the linear relationship obtained between the estimated resistance and heat produced by 8 layers of graphite cloth when the spacing between the electrodes is changed. The temperature attained under these test conditions is shown in FIG. 11.

Given an appropriate number of layers of a specific type of carbon-based cloth material and a constant AC/DC current applied to the electrodes, temperatures ranging from ambient to in excess of 1000° C. can be obtained in a relatively short time period (less than 1 minute) by making modest adjustments in the spacing between the electrodes. This temperature can then be maintained for prolonged periods without damage to the material even after repeated usage. The heating element is not based on varying the current applied and keeping resistance constant, but, conversely, on keeping the current constant and varying the resistance.

I claim:

1. A device which generates heat comprising:

first and second spaced apart electrodes, a resiliently compressible, electrically conductive heating element comprising a plurality of layers of electrically conductive carbon cloth material, said heating element being electrically connected to said spaced apart electrodes for flow of a constant electric current between said electrodes and through said heating element, said heating element generating heat on passage of said constant electric current therethrough, and means to vary the compression of said heating element at said constant electric current so as to vary the generation of heat by said heating element to achieve a desired heating temperature.

2. A device according to claim 1, wherein each layer of said plurality is in electrical contact at least with an adjacent layer of said plurality, and said means to vary the compression comprises means to vary the distance separating the spaced apart electrodes.

3. A device according to claim 2, wherein said layers of cloth material are woven, non-woven, knitted, felted or a combination thereof.

4. A heating device which comprises:

first and second spaced apart electrodes, a variable separating space defined between said spaced apart electrodes occupied by a resiliently compressible plurality of layers of electrically conductive carbon cloth material, said layers being in adjacent, side-by-side electrically contacting relationship, said plurality of layers comprising a first outer layer in electrical contact with said first electrode, and a second outer layer in electrical contact with said second electrode for flow of electric current between said first and second electrodes, at least said first electrode being adjustably positionable relative to said second electrode to vary said separating space between said electrodes while maintaining electrical contact between the adjacent layers and between said plurality of layers and said electrodes, thereby compressing or decompressing said plurality of layers, whereby the electrical resistance of said plurality of layers is varied at a constant electric current so as to vary the generation of heat by said heating element to achieve a desired heating temperature.

5. A heating device according to claim 4, further including position adjusting means adapted to adjust the position of at least said first electrode relative to said second electrode, to a plurality of positions each associated with a different length of the separating space between said electrodes and a different level compression of said plurality of layers.

6. A heating device comprising:

first and second spaced apart electrodes, a variable separating space defined between said spaced apart electrodes, occupied by a resiliently compressible, electrically conductive carbon cloth heating element in electrical contact with said electrodes and which generates heat on flow of electric current between said electrodes and through said heating element, at least said first electrode being adjustably positionable relative to said second electrode to vary said separating space such that electrical resistance of said heating element may be varied, at a constant electric current, while maintaining electrical contact between said electrodes through said heating element so as to vary the generation of heat by said heating element to achieve a desired beating temperature.

7. A heating device according to claim 6, wherein said heating element comprises a plurality of layers of electrically conductive carbon cloth material in adjacent, side-by-side electrically contacting relationship.

8. A heat generating device comprising:

first and second spaced apart electrodes, a plurality of layers of electrically conductive carbon cloth material disposed between said electrodes, for flow of a constant electric current between said electrodes, each layer of said plurality being in electrical contact with at least an adjacent layer of said plurality, said plurality comprising a first outer layer in electrical contact with said first electrode and a second outer layer in electrical contact with said second electrode, said plurality of layers being resiliently compressible between said first and second outer layers to different states of compression and having a different electric resistance associated with each different state of compression whereby a desired resistance with consequent level of heat generation is provided by a predetermined state of compression at a constant electric current.

* * * * *